US011455922B2

(12) United States Patent
Bauzon

(10) Patent No.: US 11,455,922 B2
(45) Date of Patent: Sep. 27, 2022

(54) PROTECTIVE MOTOR COVER ASSEMBLY

(71) Applicant: James Bauzon, Lancaster, PA (US)

(72) Inventor: James Bauzon, Lancaster, PA (US)

( * ) Notice: Subject to any disclaimer, the term of this patent is extended or adjusted under 35 U.S.C. 154(b) by 442 days.

(21) Appl. No.: 16/738,496

(22) Filed: Jan. 9, 2020

(65) Prior Publication Data

US 2021/0217334 A1 Jul. 15, 2021

(51) Int. Cl.
*G09F 23/00* (2006.01)
*B63H 21/36* (2006.01)

(52) U.S. Cl.
CPC ..... *G09F 23/00* (2013.01); *B63H 21/36* (2013.01)

(58) Field of Classification Search
CPC ..... G09F 23/00; B63H 21/36
See application file for complete search history.

(56) References Cited

U.S. PATENT DOCUMENTS

| | | | |
|---|---|---|---|
| 2,434,784 | A | 1/1948 | Bardin |
| 2,498,113 | A | 2/1950 | Milner |
| 3,010,124 | A | 11/1961 | Dawson |
| 5,215,485 | A | 6/1993 | Bonner |
| 5,813,361 | A | 9/1998 | Milliman |
| D568,904 | S | 5/2008 | Osumi |
| 8,002,930 | B2 | 8/2011 | Fischer |

*Primary Examiner* — Robert L Deberadinis

(57) ABSTRACT

A protective motor cover assembly includes a cylinder that is positionable over an outboard boat motor. The cylinder is comprised of a resiliently stretchable material to conform to contours of the outboard boat motor. The cylinder is comprised of an opaque material to protect the outboard boat motor from sunlight. Indicia are printed thereon on the cylinder to enhance the ornamental appearance of the outboard boat motor. A drawstring is slidably integrated into the cylinder. The drawstring closes the cylinder around the outboard boat motor when the drawstring is tightened for retaining the cylinder around the outboard boat motor.

6 Claims, 6 Drawing Sheets

PROTECTIVE MOTOR COVER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cover devices and more particularly pertains to a new cover device for protecting an outboard boat motor from sunlight and water.

(2) Description of Related Art Including Information Disclosed Under 37 CFR 1.97 and 1.98.

The prior art relates to cover devices. The prior art discloses a variety of covers for an outboard boat motor that are comprised of a non elastic material. The prior art additionally discloses a variety of covers for an outboard boat motor that are comprised of a translucent material that conforms to the shape of the outboard boat motor. The translucent material disclosed generally reflects ultraviolet radiation to protect the outboard boat motor from the ultraviolet radiation.

BRIEF SUMMARY OF THE INVENTION

An embodiment of the disclosure meets the needs presented above by generally comprising a cylinder that is positionable over an outboard boat motor. The cylinder is comprised of a resiliently stretchable material to conform to contours of the outboard boat motor. The cylinder is comprised of an opaque material to protect the outboard boat motor from sunlight. Indicia are printed thereon on the cylinder to enhance the ornamental appearance of the outboard boat motor. A drawstring is slidably integrated into the cylinder. The drawstring closes the cylinder around the outboard boat motor when the drawstring is tightened for retaining the cylinder around the outboard boat motor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
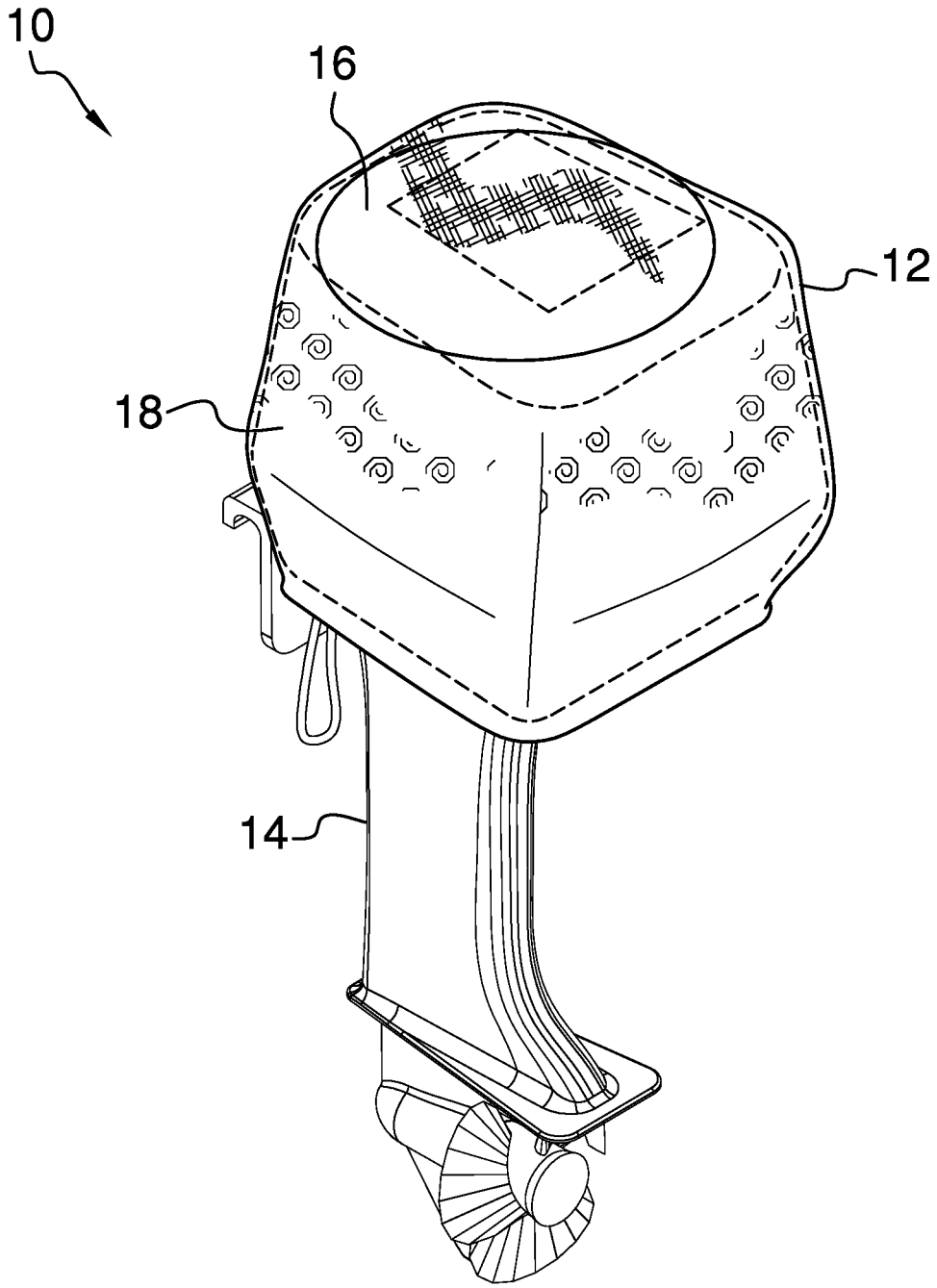
FIG. 1 is a perspective in-use view of a protective motor cover assembly according to an embodiment of the disclosure.
Figure 2:
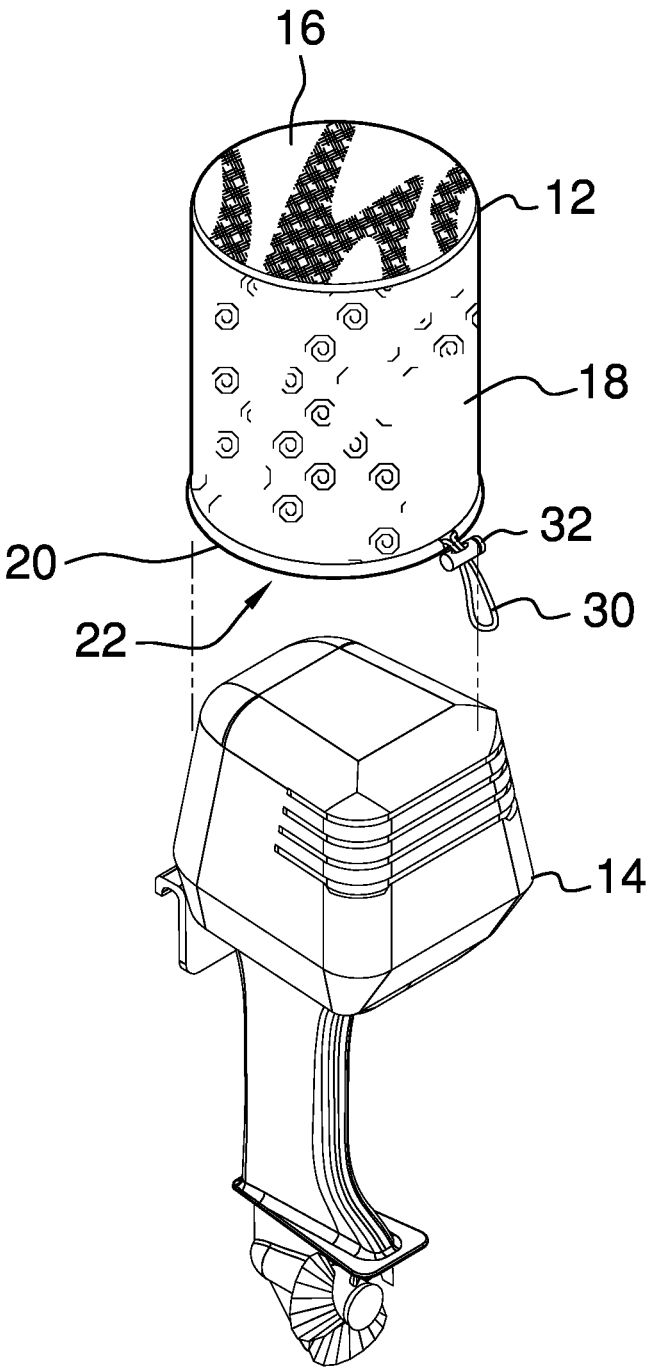
FIG. 2 is an exploded perspective view of an embodiment of the disclosure.
Figure 3:
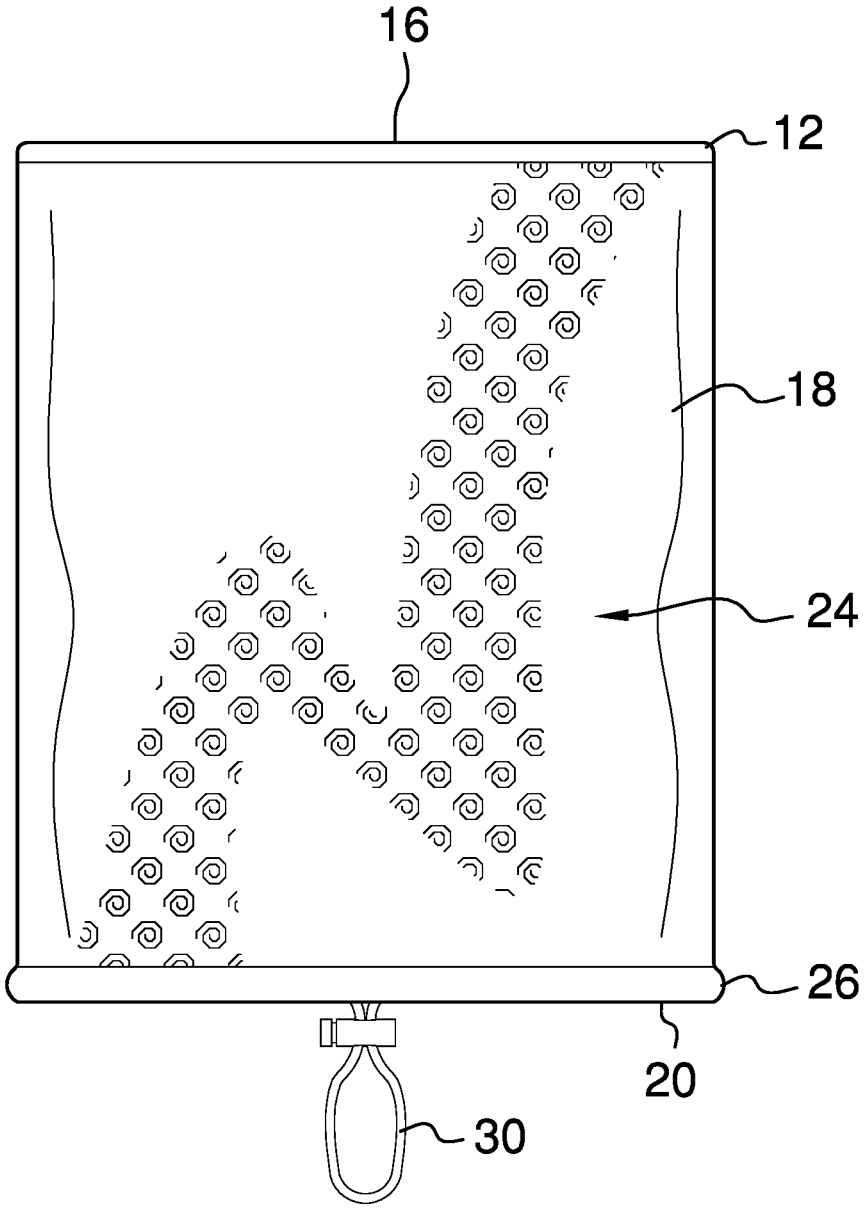
FIG. 3 is a back view of a cylinder of an embodiment of the disclosure.
Figure 4:
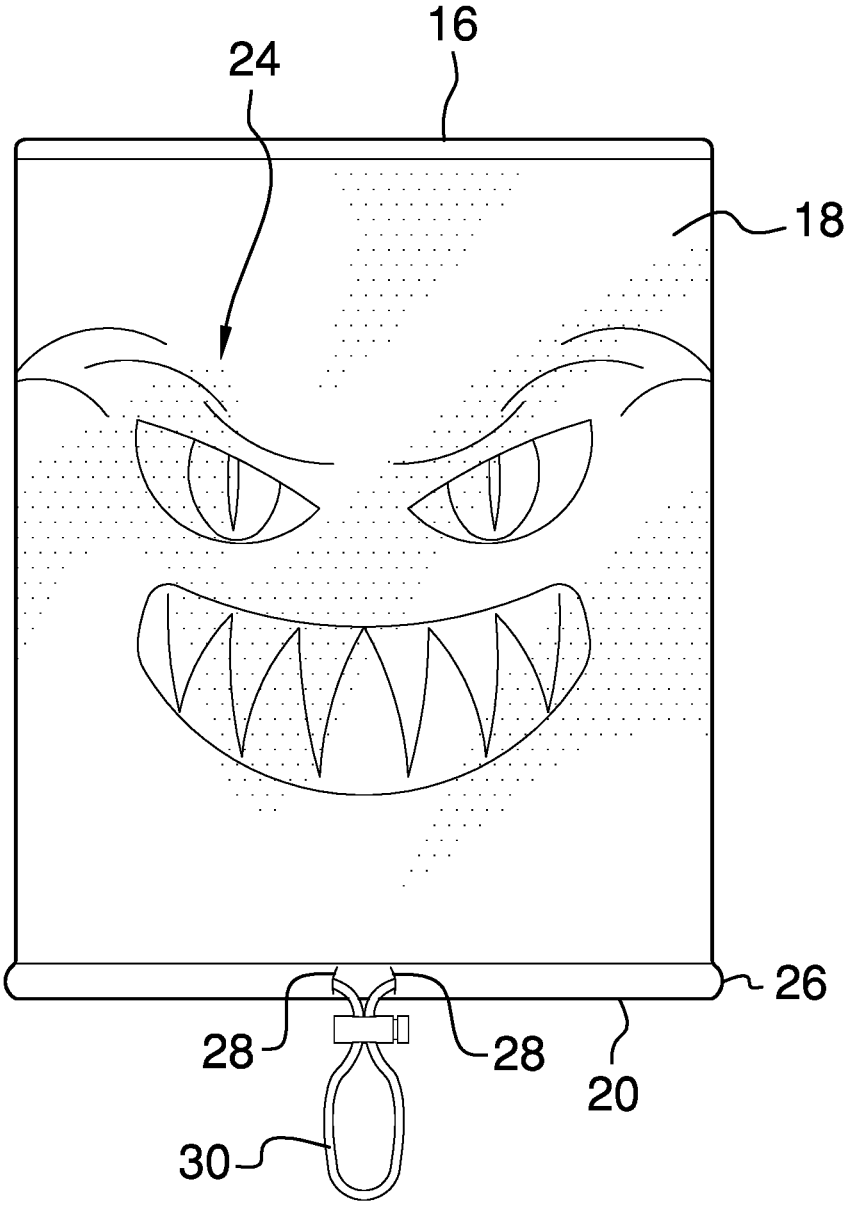
FIG. 4 is a front view of an embodiment of the disclosure.
Figure 5:
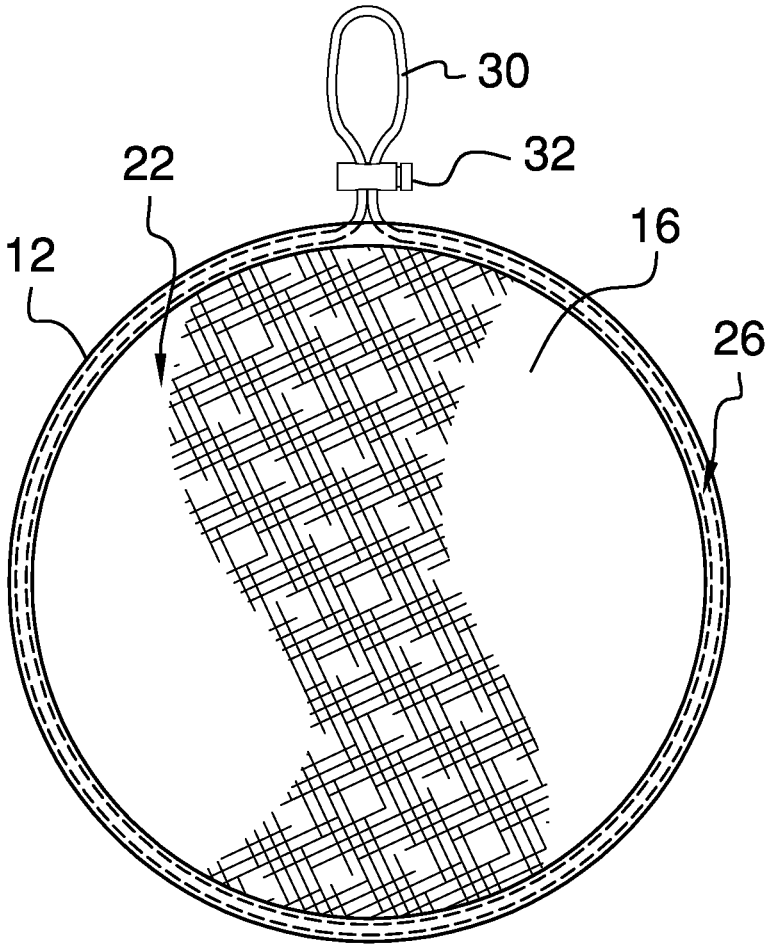
FIG. 5 is a bottom view of an embodiment of the disclosure.
Figure 6:
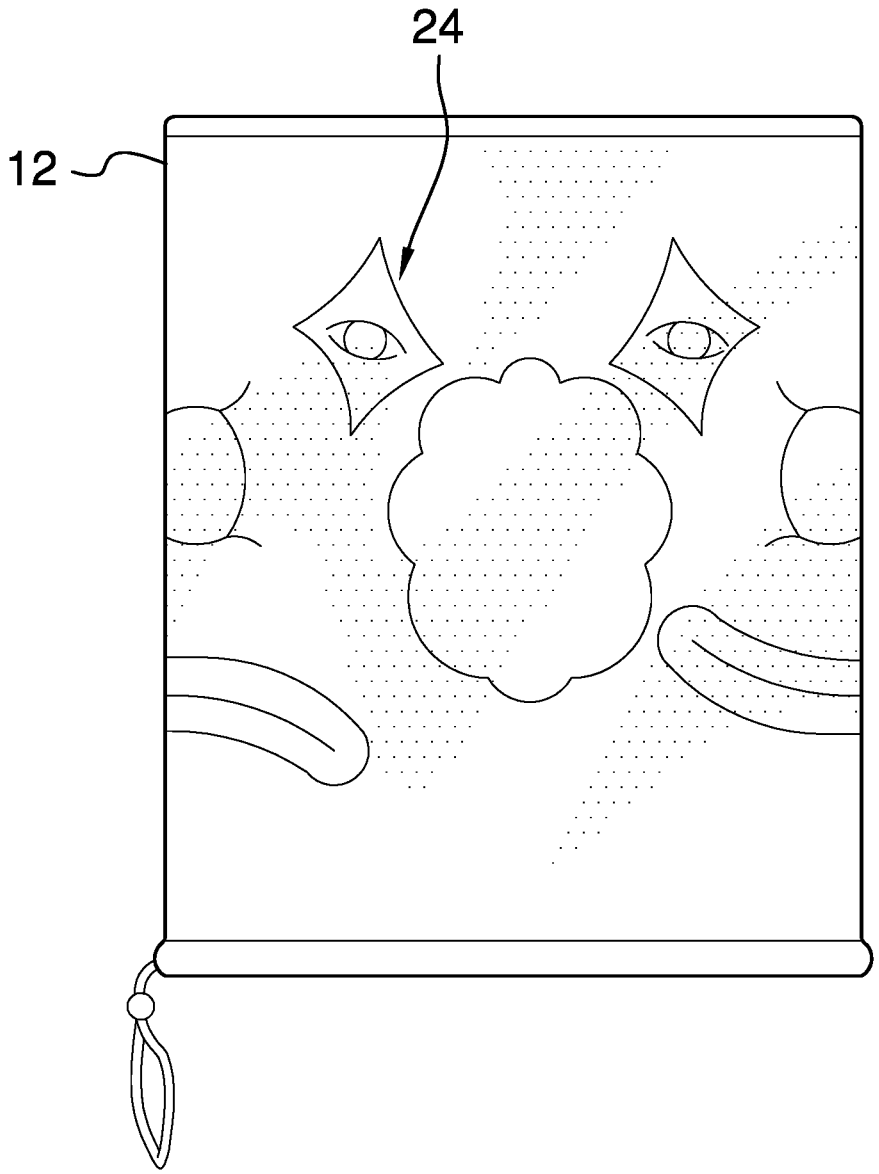
FIG. 6 is a left side view of an embodiment of the disclosure.

With reference now to the drawings, and in particular to FIGS. 1 through 6 thereof, a new cover device embodying the principles and concepts of an embodiment of the disclosure and generally designated by the reference numeral 10 will be described.

As best illustrated in FIGS. 1 through 6, the protective motor cover assembly 10 generally comprises a cylinder 12 that is positionable over a motor housing of an outboard boat motor 14. The cylinder 12 is comprised of a resiliently stretchable material to conform to contours of motor housing of the outboard boat motor 14. The resiliently stretchable material may comprise spandex or other elastomeric material that is fluid impermeable. The cylinder 12 is comprised of an opaque material to protect the motor housing of the outboard boat motor 14 from sunlight. In this way the cylinder 12 enhances the life span of paint and decals on the outboard boat motor 14.

The cylinder 12 has a top wall 16 and an outer wall 18 extending downwardly therefrom. The outer wall 18 has a distal edge 20 with respect to the top wall 16 defining an opening 22 into the cylinder 12 to receive the outboard boat motor 14. Indicia 24 are printed on the outer wall 18 and the indicia 24 comprise imagery for enhancing the ornamental appearance of the outboard boat motor 14. The imagery may be geometric shapes, a repeating pattern, a logo or any chosen imagery. A channel 26 is integrated into the outer wall 18 and the channel 26 is coextensive with the distal edge 20. Moreover, the outer wall 18 has a pair of openings 28 each extending into the channel 26 and the openings 28 are spaced apart from each other.

A drawstring 30 is slidably integrated into the cylinder 12. The drawstring 30 closes the cylinder 12 around the outboard boat motor 14 when the drawstring 30 is tightened. In this way the cylinder 12 is retained around the outboard boat motor 14. The drawstring 30 is positioned in the channel 26 and the drawstring 30 extends outwardly through each of the openings 22 in the outer wall 18 of the cylinder 12.

A closure 32 is provided and the drawstring 30 slidably extends therethrough. The closure 32 retains the drawstring 30 in a tightened condition for retaining the cylinder 12 around the outboard boat motor 14 when the closure 32 engages the drawstring 30. Additionally, the closure 32 is manipulated to disengage the drawstring 30 to facilitate the drawstring 30 to be loosened. The closure 32 may include a slide and a button that is slidably positioned in the slide. The drawstring 30 may extend through the slide and the button may frictionally engage the drawstring 30.

In use, the cylinder 12 is positioned over the outboard boat motor 14 to protect the outboard boat motor 14 from sunshine, water and debris. The indicia 24 on the cylinder 12 enhance the ornamental appearance of the outboard boat motor 14. The drawstring 30 is tightened to close cylinder 12 around the outboard boat motor 14. The closure 32 is manipulated to loosen the drawstring 30 for removing the cylinder 12 from the outboard boat motor 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A protective motor cover assembly being configured to be positioned around an outboard boat motor for protecting the outboard boat motor, said assembly comprising:

a cylinder being positionable over an outboard boat motor, said cylinder being comprised of a resiliently stretchable material wherein said cylinder is configured to conform to contours of the outboard boat motor, said cylinder being comprised of an opaque material wherein said cylinder is configured to protect the outboard boat motor from sunlight, said cylinder having indicia being printed thereon, said indicia comprising imagery for enhancing the ornamental appearance of the outboard boat motor; and a drawstring being slidably integrated into said cylinder, said drawstring closing said cylinder around the outboard boat motor when said drawstring is tightened for retaining said cylinder around the outboard boat motor.

2. The assembly according to claim 1, wherein said cylinder has a top wall and an outer wall extending downwardly therefrom, said outer wall having a distal edge with respect to said top wall defining an opening into said cylinder wherein said opening is configured to receive the outboard boat motor, said indicia being positioned on said outer wall of said cylinder.

3. The assembly according to claim 2, wherein said outer wall has a channel being integrated therein, said channel being coextensive with said distal edge, said outer wall having a pair of openings each extending into said channel, said openings being spaced apart from each other.

4. The assembly according to claim 3, wherein said drawstring is positioned in said channel, said drawstring extending outwardly through each of said openings in said outer wall of said cylinder.

5. The assembly according to claim 1, further comprising a closure having said drawstring slidably extending therethrough, said closure retaining said drawstring in a tightened condition for retaining said cylinder around the outboard boat motor when said closure engages said drawstring, said closure being manipulated to disengage said drawstring to facilitate said drawstring to be loosened.

6. A protective motor cover assembly being configured to be positioned around an outboard boat motor for protecting the outboard boat motor, said assembly comprising:

a cylinder being positionable over an outboard boat motor, said cylinder being comprised of a resiliently stretchable material wherein said cylinder is configured to conform to contours of the outboard boat motor, said cylinder being comprised of an opaque material wherein said cylinder is configured to protect the outboard boat motor from sunlight, said cylinder having a top wall and an outer wall extending downwardly therefrom, said outer wall having a distal edge with respect to said top wall defining an opening into said cylinder wherein said opening is configured to receive the outboard boat motor, said outer wall having indicia being printed thereon, said indicia comprising imagery for enhancing the ornamental appearance of the outboard boat motor, said outer wall having a channel being integrated therein, said channel being coextensive with said distal edge, said outer wall having a pair of openings each extending into said channel, said openings being spaced apart from each other;

a drawstring being slidably integrated into said cylinder, said drawstring closing said cylinder around the outboard boat motor when said drawstring is tightened for retaining said cylinder around the outboard boat motor, said drawstring being positioned in said channel, said drawstring extending outwardly through each of said openings in said outer wall of said cylinder; and a closure having said drawstring slidably extending therethrough, said closure retaining said drawstring in a tightened condition for retaining said cylinder around the outboard boat motor when said closure engages said drawstring, said closure being manipulated to disengage said drawstring to facilitate said drawstring to be loosened.

* * * * *